US010857057B2

(12) United States Patent
Kousik

(10) Patent No.: US 10,857,057 B2
(45) Date of Patent: Dec. 8, 2020

(54) WALKER

(71) Applicant: Medline Industries, Inc., Northfield, IL (US)

(72) Inventor: Arun Kousik, Northbrook, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 16/280,655

(22) Filed: Feb. 20, 2019

(65) Prior Publication Data

US 2020/0261300 A1 Aug. 20, 2020

(51) Int. Cl.
*A61H 3/04* (2006.01)
*A61H 3/02* (2006.01)

(52) U.S. Cl.
CPC ..... *A61H 3/04* (2013.01); *A61H 3/0244* (2013.01)

(58) Field of Classification Search
CPC ..... A61H 3/04; A61H 3/00; A61H 3/0244; B62B 7/04; B62B 7/06; B62B 9/087; B62B 3/02
USPC ..... 135/65, 67, 74, 84, 85; 280/642, 647, 280/43.17, 47.34, 87.021, 87.051; 482/68
See application file for complete search history.

(56) References Cited

U.S. PATENT DOCUMENTS 2,855,024 A * 10/1958 Robb ..... A61H 3/00 135/67
4,341,381 A * 7/1982 Norberg ..... A61H 3/04 135/67
5,201,333 A * 4/1993 Shalmon ..... A61H 3/00 135/67
5,579,793 A * 12/1996 Gajewski ..... A61H 3/00 135/67
6,688,633 B2 * 2/2004 van't Schip ..... A61H 3/04 135/67
7,001,313 B1 * 2/2006 Crnkovich ..... A61H 3/04 135/67
7,306,246 B2 * 12/2007 Gale ..... A61H 3/04 280/47.34
8,333,208 B2 * 12/2012 Miller ..... A61H 3/04 135/67
8,418,705 B2 * 4/2013 Ota ..... A61H 3/04 135/71
8,944,457 B2 * 2/2015 Rembisz ..... B62B 7/086 280/647
9,180,066 B2 * 11/2015 Izard ..... A61H 3/008
9,597,251 B2 3/2017 Liles
9,657,770 B2 * 5/2017 Moller ..... A61H 3/04
(Continued)

*Primary Examiner* — Noah Chandler Hawk
(74) *Attorney, Agent, or Firm* — Fitch, Even, Tabin & Flannery LLP

(57) ABSTRACT

Disclosed is a collapsible walker that is movable between an upright and a collapsed position. The walker includes a visible indication that the walker is in the upright position. The indicator device includes a visual indicator affixed to the collapsible walker, wherein the visual indicator includes a first section and a second section, and a window disposed on the body. The walker is configured such that when the walker is in the upright position the first section of the visual indicator is visible via the window, and when the walker is not in the upright position at least a portion of the second section of the visual indicator is visible via the window, the visibility of at least a portion of the second section signifying that the walker is not ready for use.

16 Claims, 7 Drawing Sheets

(56) References Cited

U.S. PATENT DOCUMENTS

| | | | | |
|---|---|---|---|---|
| 9,861,549 | B2 * | 1/2018 | Karlovich | A63B 22/02 |
| 2008/0029138 | A1 * | 2/2008 | Foote | A61H 3/00 135/67 |

* cited by examiner

WALKER

TECHNICAL FIELD

This application relates generally to mobility aids and, more particularly, to walkers.

BACKGROUND

Many people with limited mobility rely on walkers or other such devices to aid in walking. One area in which those using walkers encounter risk is when moving from a seated position to a standing position with the walker. During this transition, a person will typically rely on the walker for support and to aid him or herself in lifting his or her body from the seated position. When the person reaches away from his or her body to grasp the walker and lift him or herself, this presents a fall risk.

Currently, walkers exist that collapse from an upright position into a collapsed position, the handlebar or other grasping portion of the walker being lower to the ground in the collapsed position so that a person does not need to reach as far to grasp the walker. These walkers may be raised into the upright position and locked when fully raised. Some such walkers do not offer the user much in the way of confirmation with regard to locking. For example, a person may have to rely on a "clicking" noise when the walker was locked. Particularly for hearing-impaired people, it can be difficult for the user to know that such a walker is locked in the upright position and safe to use. If a user attempts to walk with the assistance of the walker when the walker is not fully locked, this again presents a fall risk.

Described herein are collapsible walkers that include a visual indicator, and an indicator device for collapsible walkers. The device includes a visual indicator affixable to the collapsible walker, wherein the visual indicator includes a first section and a second section; a lock indicator cover configured to be secured to a portion of collapsible walker proximal the visual indicator; and a window disposed on the lock indicator cover. The device is configured such that when the walker is in the upright position the first section of the visual indicator is visible through the window, and when the walker is not in the upright position at least a portion of the second section of the visual indicator is visible through the window, the visibility of at least a portion of the second section signifying that the walker is not in a use position. In this manner, the visual indicator provides a quick way for the user to assess the condition of the collapsible walker.

DETAILED DESCRIPTION

Figure 1:
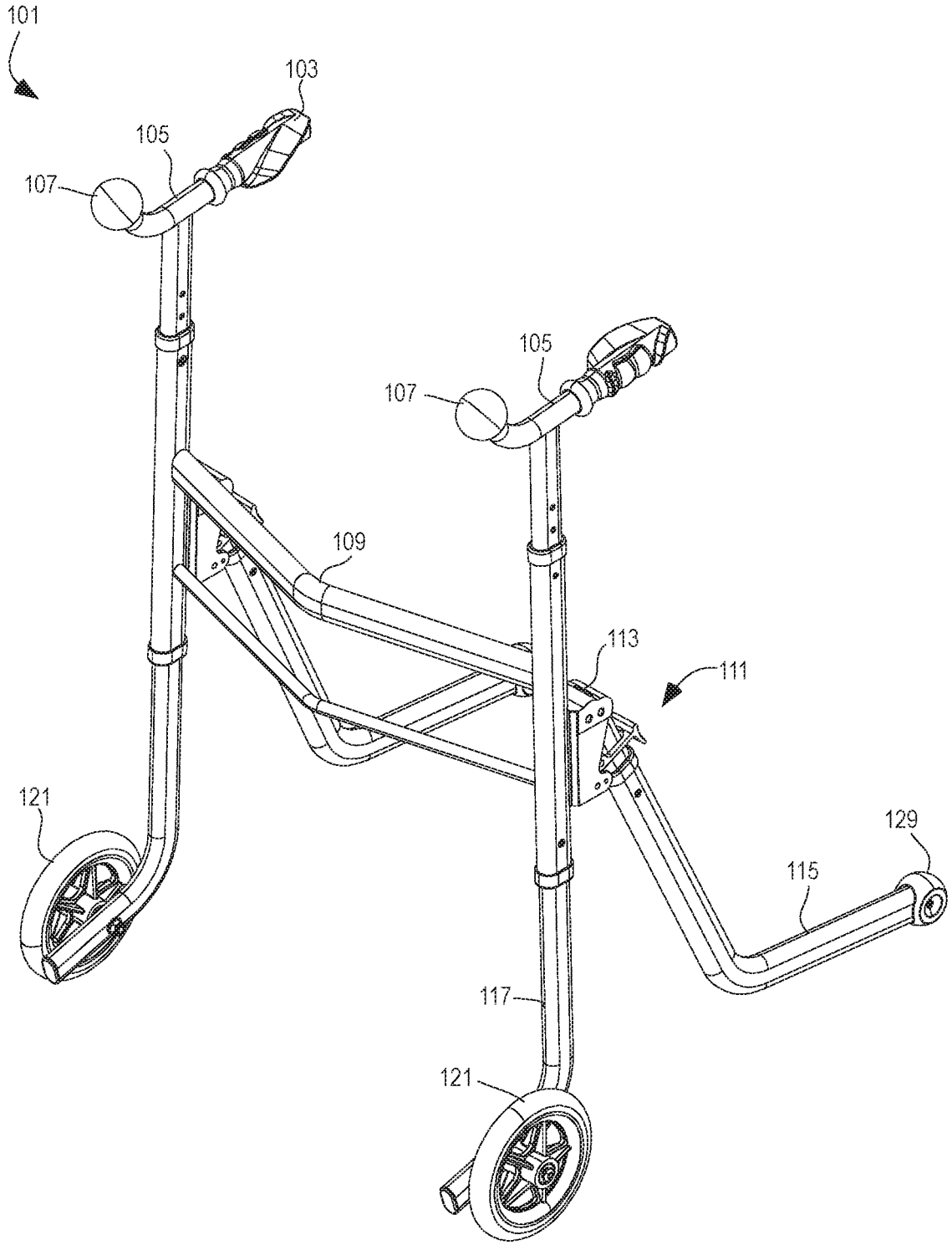
FIG. 1 is a perspective view of a collapsible walker in an upright orientation and including a lock indicator cover.

With reference to FIG. 1, the collapsible walker 101 includes a main body frame assembly 109. Affixed to the main body frame assembly 109 are handlebars 105, front legs 117, and rear legs 115. The walker 101 is collapsible from a first position (the upright orientation depicted in FIGS. 1 and 2) into a second position (the collapsed orientation depicted in FIG. 3).

The handlebars 105 extend upwardly from the main body frame assembly 109. The handlebars 105 includes handle grips 103 and ball grips 107, which a user can grasp. The front legs 112 include wheels 121 to aid in mobility of the collapsible walker 101. The rear legs 115 includes casters 129, which are smooth or rounded caps that are designed to glide or roll across a surface. The rear legs 115 are pivotably coupled to the main body frame assembly 109 via hinges 111. The rear legs 115 are pivotably coupled to the main body frame assembly 109 such that the rear legs 115 can pivot from a first position to a second position. That is, the collapsible walker is collapsible from the upright orientation into the collapsed orientation via movement of the rear legs 115 with respect to the main body frame assembly 109.

Figure 2:
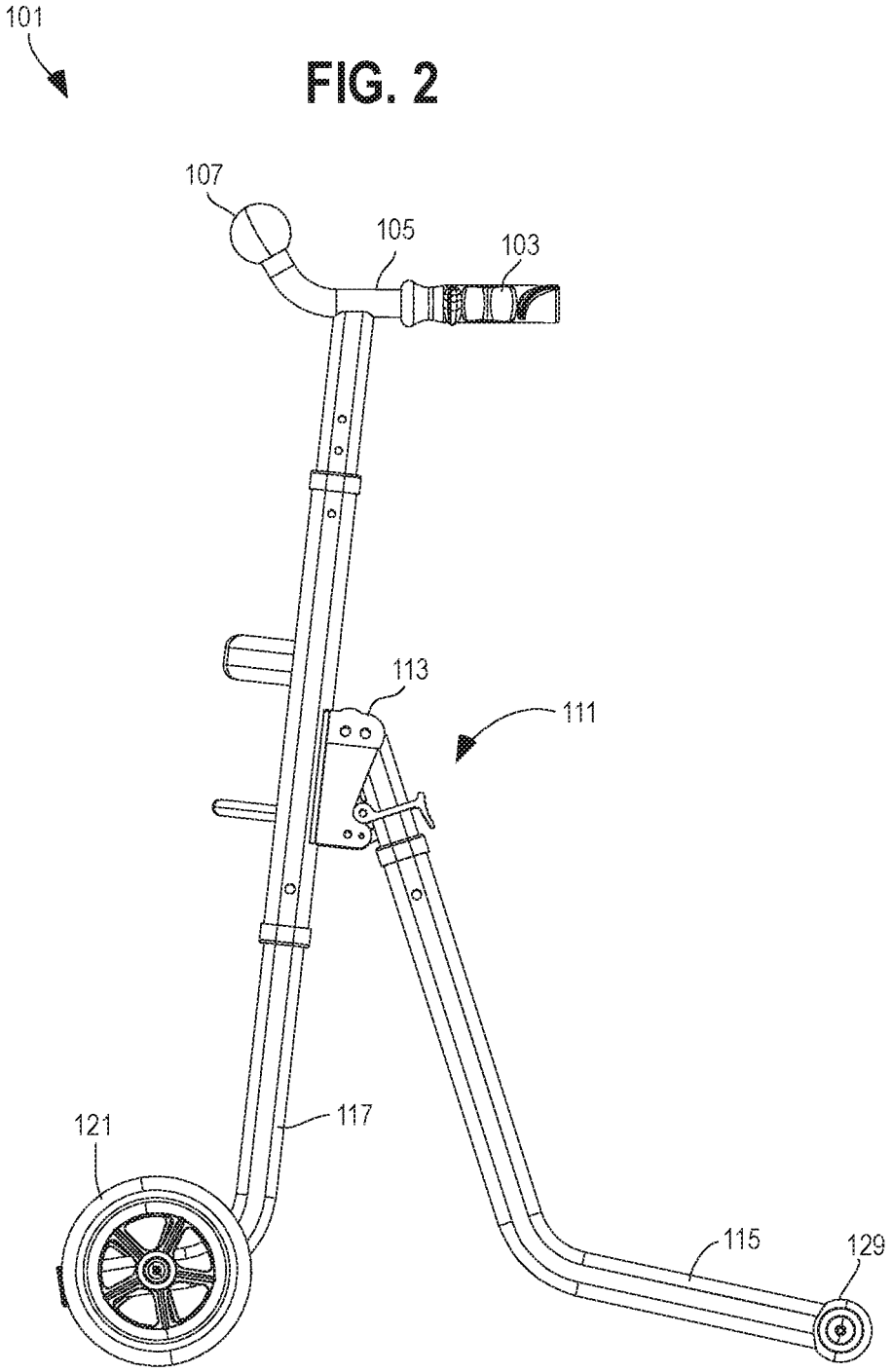
FIG. 2 is a side elevational view of the collapsible walker of FIG. 1 in the upright orientation.
Figure 3:
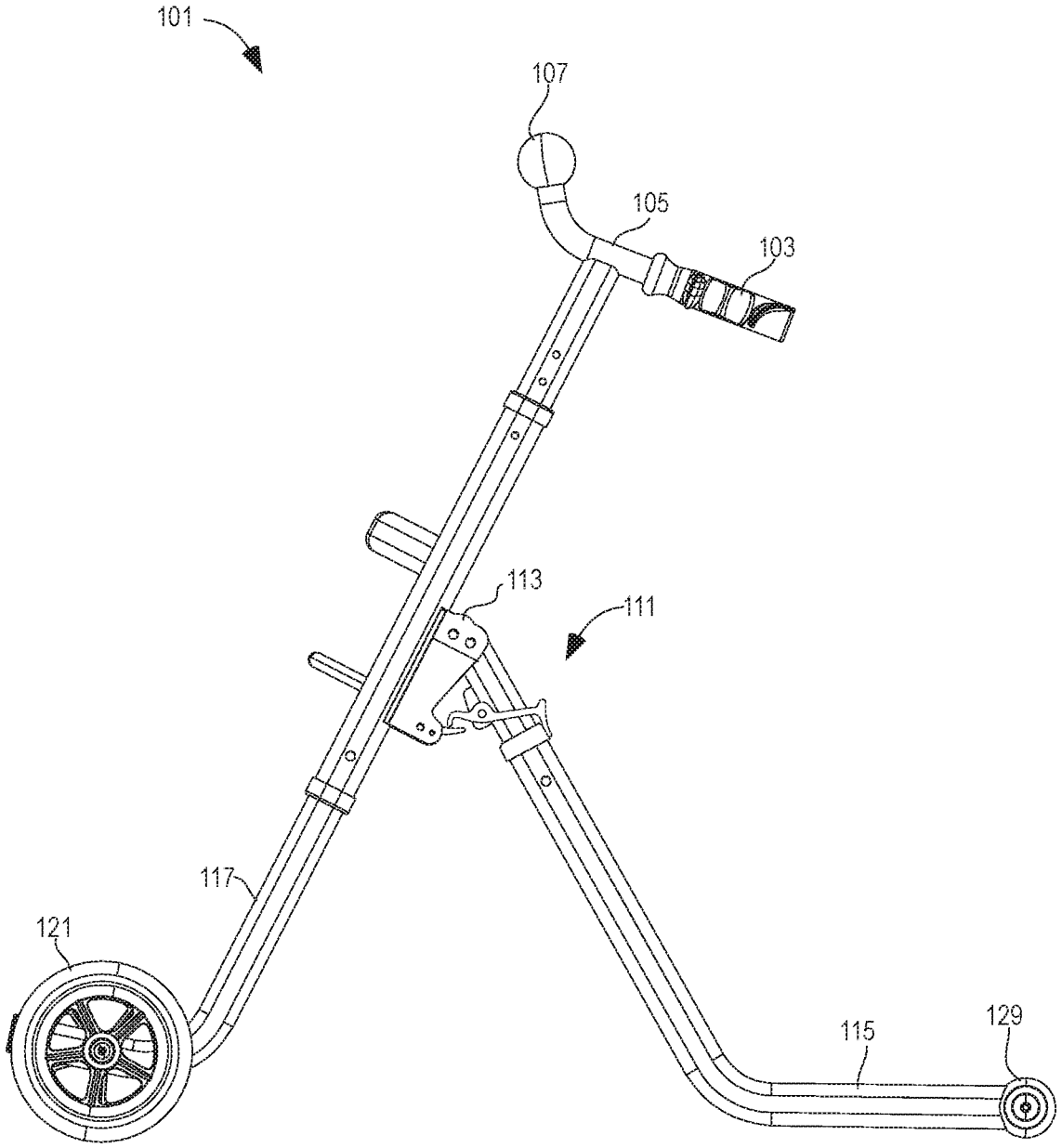
FIG. 3 is a side view of the collapsible walker of FIG. 1 in a collapsed orientation.
Figure 4:
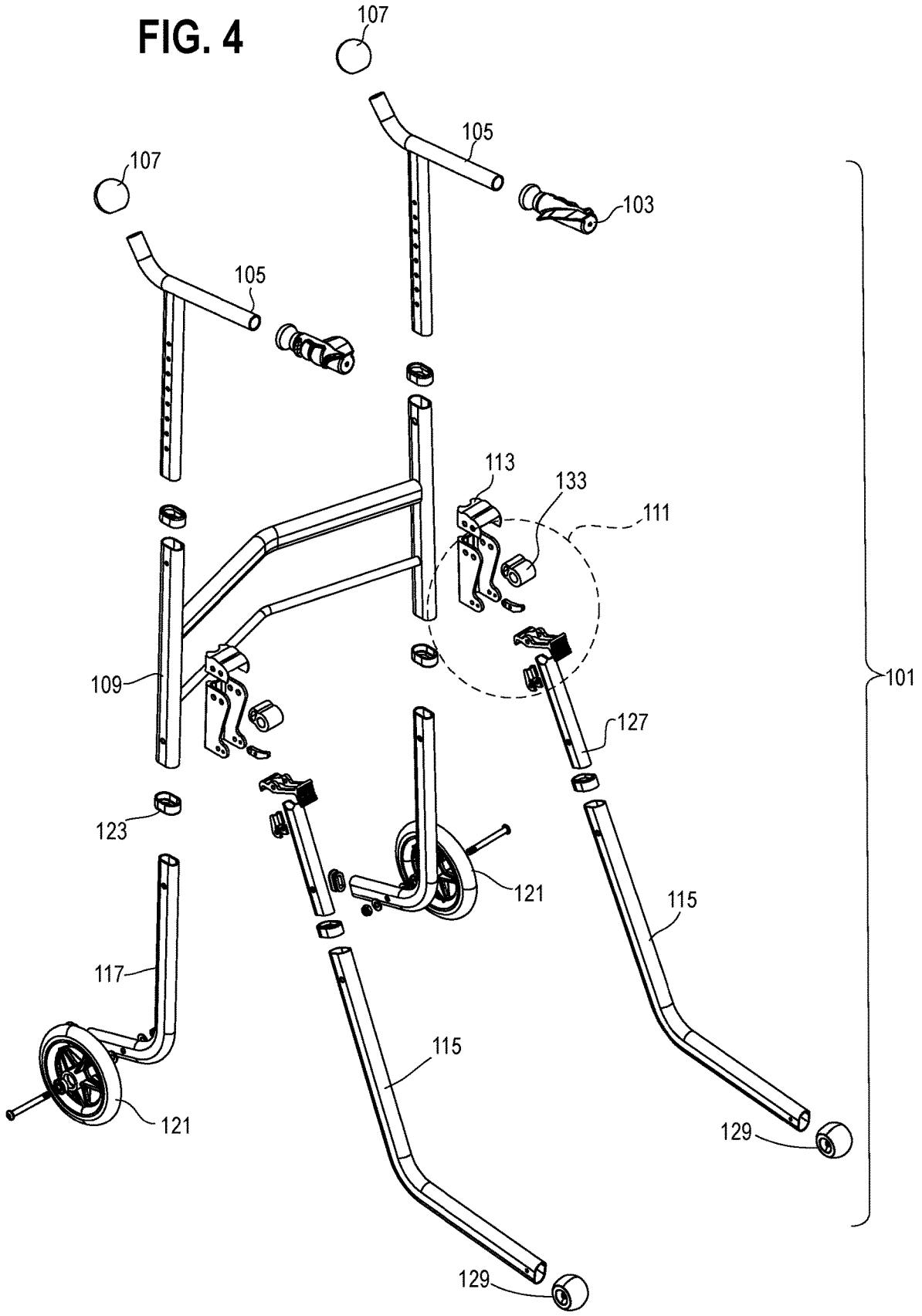
FIG. 4 is an exploded view of the collapsible walker of FIG. 1 depicting a hinge and the lock indicator cover.

FIG. 2 depicts the collapsible walker 101 in the upright orientation (also referred to as the "use position") and FIG. 3 depicts the collapsible walker 101 in the collapsed orientation. When moving from the upright orientation to the collapsed orientation, the rear legs 115 pivot away from the front legs 117. In some embodiments, such action causes the handlebars 105 to pivot toward the user, allowing the user to more easily stand from the seated position.

Figure 5:
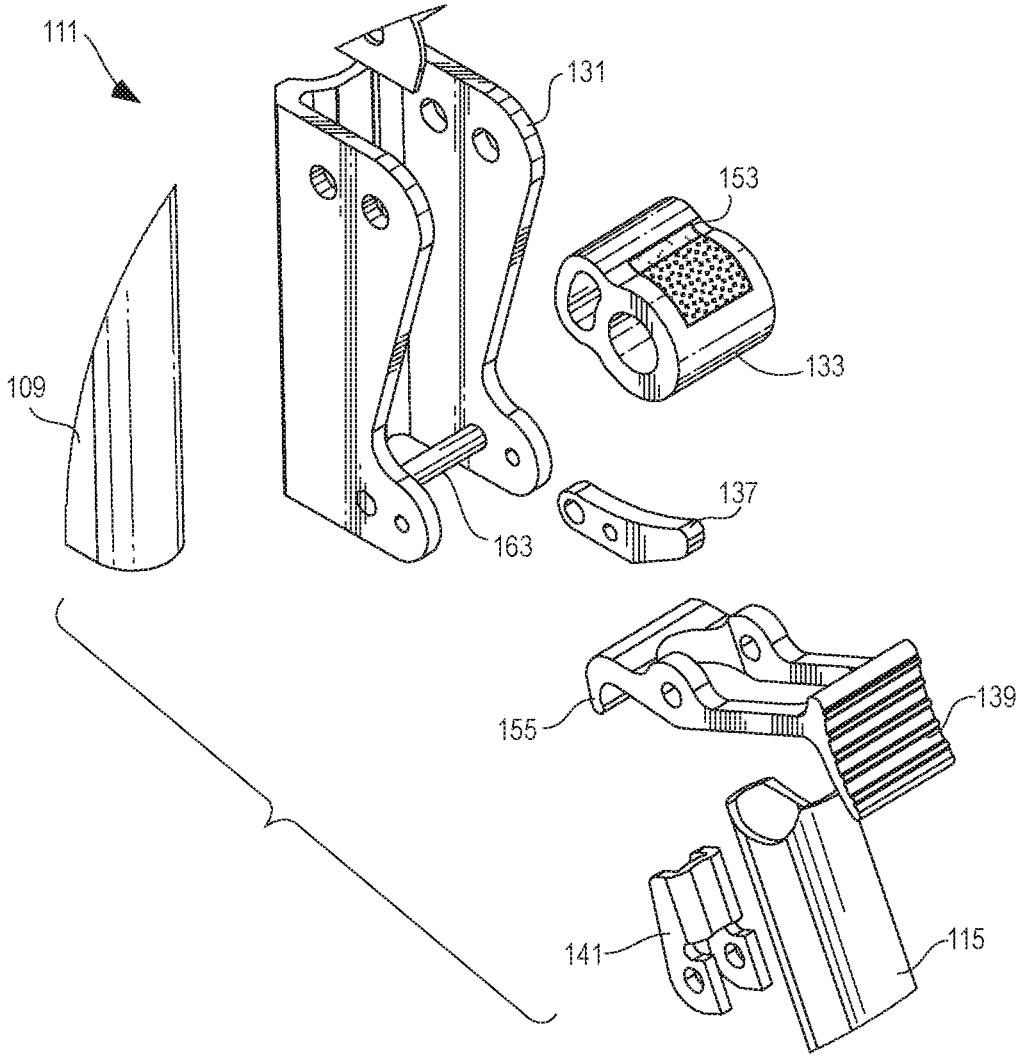
FIG. 5 is an exploded view of the hinge depicted in FIG. 4.
Figure 6:
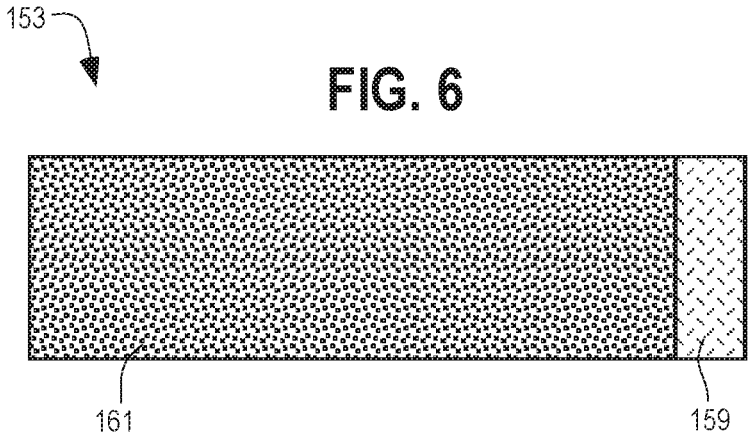
FIG. 6 depicts an exemplary visual indicator.
Figure 7:
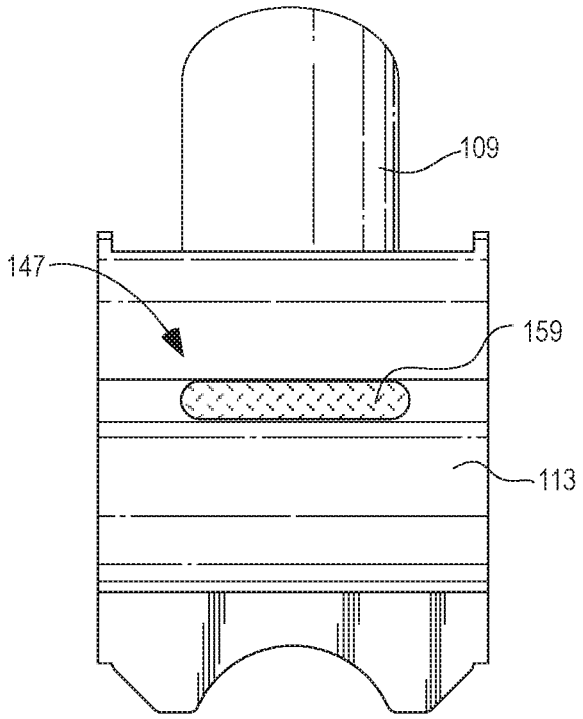
FIG. 7 is a top view of the lock indicator cover when the collapsible walker is in the upright position.

One or both of the hinges 111 include a visual indicator 153, as depicted in FIGS. 5 and 6. The visual indicator 153 moves with the rear leg 115. A lock indicator cover 113 is positioned above one, or both, of the hinges 111 (depicted in more detail with respect to FIGS. 9-11). The lock indicator cover 113 includes a window 147, as shown in FIG. 7, such that the visual indicator 153 is visible through the window 147. Preferably, the visual indicator 153 is visible by the user when the user is in a standing position.

Figure 8:
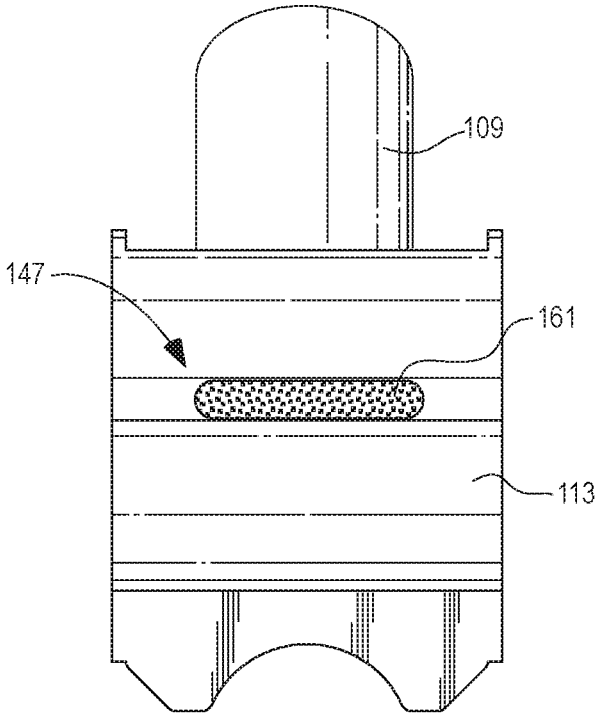
FIG. 8 is a top view of the lock indicator cover when the collapsible walker is in the collapsed position.

As the collapsible walker 101 is moved from the first position to the second position, a different section of the visual indicator 153 becomes visible through the window 147, as depicted in FIGS. 7 and 8. In some embodiments, the visual indicator 153 allows the user to quickly and easily determine if the collapsible walker 101 is in the first position (i.e., upright orientation) and thus, safe to use. For example, the section of the visual indicator 153 that indicates that the collapsible walker 101 is safe to use will be visible through the window 147 when the collapsible walker 101 is locked in the first position. Similarly, at least a portion of the section that indicates that the collapsible walker 101 is not in the first orientation will be visible when the collapsible walker 101 is not locked in the first position.

In FIG. 7, the first section 159 of the visual indicator 153 is visible via the window 147. The first section 159 of the visual indicator 153 is visible via the window 147 because the collapsible walker 101 is locked in the first position. That is, because the collapsible walker 101 is locked in the first position it is safe to use, as indicated by the first section 159 of the visual indicator being visible through the window 147. Preferably, when the collapsible walker 101 is locked in the first position, none of the second section 161 of the visual indicator 153 will be visible through the window 147. In some embodiments, a protective layer (not shown), such as clear or translucent plastic or glass can be fit inside the window 147.

In FIG. 8, the second section 161 of the visual indicator 153 is visible via the window 147. The second section 161 of the visual indicator 153 is visible via the window 147 because the collapsible walker 101 is not locked in the first position. Instead, the collapsible walker 101 is in the second position or somewhere between the second position and the first position, i.e., neither fully upright nor fully collapsed. Because the collapsible walker 101 is not locked in the first position it is not deemed safe for use position, and this status is indicated by at least a portion of the second section 161 of the visual indicator 153 being visible through the window 147.

The exemplary hinge 111 depicted in FIG. 5 includes a hinge support frame 131, a hinge joint 133, a guide track 137, a lever 139, and lever connectors 141. The hinge 111 movably couples the rear legs 115 to the main body frame assembly 109. That is, the hinge 111 allows the rear legs to pivot or otherwise move with respect to the main body frame assembly so that the collapsible walker 101 can be moved between the first and second positions.

Returning to FIG. 5, the hinge support frame 131 couples the hinge 111 to the main body frame assembly 109. For example, the hinge support frame 131 can include a plurality of apertures which align with apertures of the main body frame assembly 109 through which fasteners (e.g., bolts, screws, pins, etc.) can be used to secure the hinge 111 to the main body frame assembly 109.

The lever 139 is coupled to the hinge support frame 131 via the lever connectors 141. The lever 139 is movable within the hinge support frame 131. The illustrated lever 139 pivots to lock and unlock the hinge 111. In such embodiments, actuation of the lever 139 allows the collapsible walker 101 to be moved between the first and second positions. The lever 139 includes an engagement mechanism 155 that mates with the hinge support frame 131. The engagement mechanism 155 includes a hook that mates with a locking structure 163, which in the illustrated embodiment comprises a rod in the hinge support frame 131. Actuation of the lever 139 causes the engagement mechanism 155 to release from the hinge support frame 131. Additionally, in some embodiments, the user can slightly lift or raise the collapsible walker 101 to cause engagement between the engagement mechanism 155 and the hinge support frame 131 to lock the collapsible walker 101 in the first position (i.e., the upright orientation). For example, the user can lift the collapsible walker 101 via the handlebar 105. When the user lifts the collapsible walker 101, the rear leg 115 pivots toward the front leg 117 due to the gravitational forces acting upon the rear leg 115. In such embodiments, the action of the gravitational forces is such that the momentum of the rear leg 115 during the pivoting causes the engagement mechanism 155 of the lever 139 to engage the locking structure 163, thus locking the collapsible walker 101 in the upright position.

The hinge 111 pivots via the hinge joint 133. In some embodiments, the visual indicator 153 is affixed to the hinge joint 133. The markings be of any suitable type, such as colors, patterns, words, etc. That is, the visual indicator 153 can be color-coded, pattern-coded, word-coded, etc. For example, the first section 159 can be green and the second section 161 can be red. In this example, when the collapsible walker 101 is locked in the first position (i.e., the upright orientation), the green first section 159 is visible via the window 147 of the lock indicator cover 113. Likewise, when the collapsible walker 101 is not locked in the first position (e.g., when the collapsible walker 101 is in the second position (i.e., the collapsed orientation), the red second section 161 is visible via the window 147 of the lock indicator cover 113. In this example, the user can quickly determine whether the collapsible walker 101 is in the first position based on the color that is visible via the window 147 of the lock indicator cover 113. The visual indicator 153 can be separate from the components of the hinge 111 (e.g., a sticker that is affixed to the hinge joint 133) or be integral with one or more of the components of the hinge 111 (e.g., the hinge joint 133 may be multicolored and serve the function of the visual indicator 153).

Figure 9:
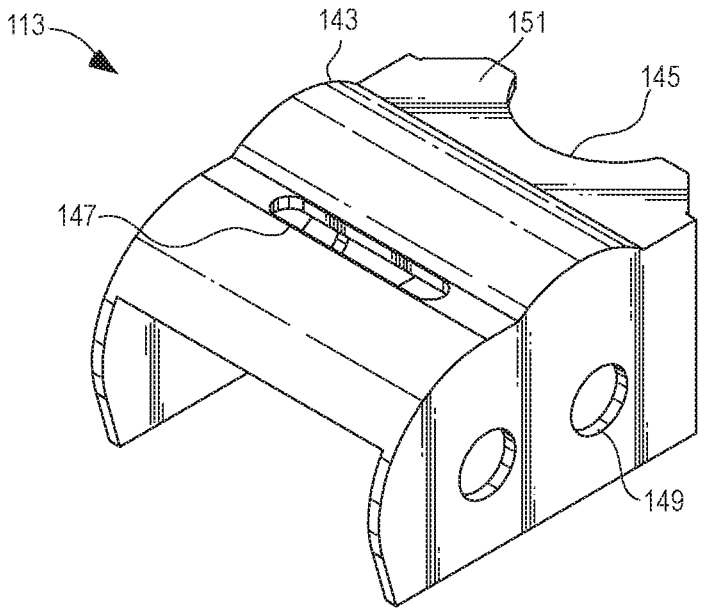
FIG. 9 is a perspective view of the lock indicator cover shown in FIG. 1.
Figure 10:
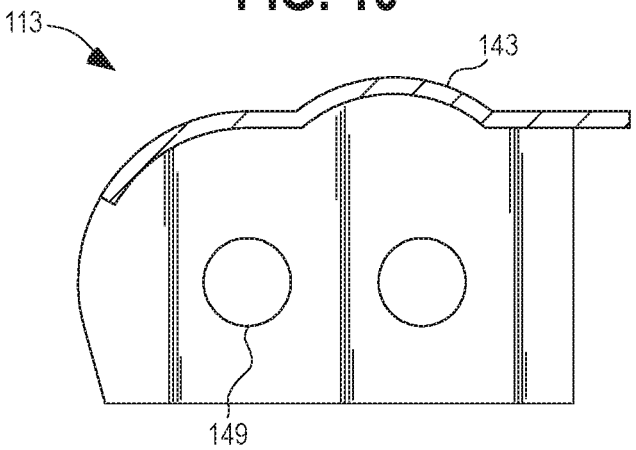
FIG. 10 is a cross sectional view of the lock indicator cover of FIG. 9 taken along line 10-10 of FIG. 11.
Figure 11:
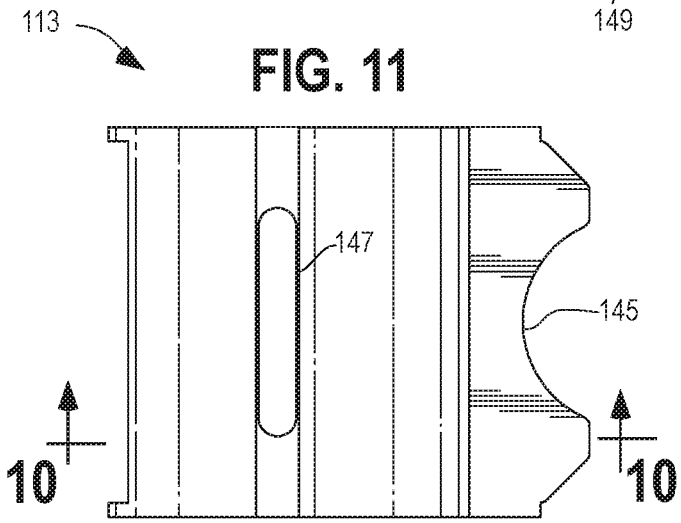
FIG. 11 is a top view of the lock indicator cover of FIG. 9.

The lock indicator cover 113, as depicted in detail in FIGS. 9-11, comprises a body 151. The body can be formed of any suitable material, such as plastic, metal, etc. Although depicted as a single structure in FIGS. 9-11, such is not required. For example, in some embodiments, the body 151 may comprise multiple components affixed to one another.

The body 151 is shaped to be compatible with the collapsible walker 101. Specifically, the lock indicator cover 113 has a geometry such that it will cover at least a portion of the hinge 111. For example, as depicted in FIGS. 9-10, the body of the lock indicator cover 113 includes a convex region 143 and a concave region 145. The convex region 143 is shaped and positioned such that movement of the hinge 111, as well as that of the rear legs 115, is not inhibited by the lock indicator cover 113. The concave region 145 is shaped such that the lock indicator cover 113 complements the shape of the structure of the main body frame assembly 109. In some embodiments, the body 151 of the lock indicator cover 113 can be shaped and/or sized to be retrofitted onto an existing walker. That is, the lock indicator cover 113 can be made having any shape and size suitable to fit an existing walker and does not necessarily need to be designed in concert with a specific walker.

The body 151 includes mounting points 149. The mounting points 149 are configured to accept fasteners, such as screws, bolts, pins, rods, etc. The mounting points 149 are positioned to align with corresponding mounting points on the collapsible walker 101. As previously discussed, the lock indicator cover 113 can be retrofit for use with existing walkers. Accordingly, the mounting points 149 can be positioned as necessary to align with corresponding mounting points on an existing walker or can be large enough to accept fasteners at a number of locations to accommodate differing locations of corresponding mounting points on existing walkers.

All methods described herein can be performed in any suitable order unless otherwise indicated herein or otherwise clearly contradicted by context. The use of any and all examples, or language describing an example (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. An indicator device for a collapsible walker, the walker being movable from a locked walking position over a range of unlocked positions into a fully collapsed position the walker including a lock for securement into the locked walking position, the indicator device comprising:

a visual indicator affixable to the collapsible walker, wherein the visual indicator includes a first section and a second section;

a lock indicator cover configured to be secured to a portion of the collapsible walker proximal the visual indicator;

a window disposed on the lock indicator cover, wherein when the walker is in the locked walking position the first section of the visual indicator is visible through the window, and when the walker is not in the locked walking position at least a portion of the second section of the visual indicator is visible through the window, the visibility of at least a portion of the second section signifying that the walker is not in the locked walking position.

2. The lock indicator cover of claim 1, wherein the visual indicator is one or more of color-coded and pattern-coded.

3. The lock indicator cover of claim 1, wherein the first section of the visual indicator includes a first color and wherein the second section of the visual indicator includes a second color.

4. The lock indicator cover of claim 1, wherein the first section of the visual indicator includes a first pattern and wherein the second section of the visual lock indicator includes a second pattern.

5. The indicator device of claim 1, wherein the fully collapsed position is a non-walking position for the user.

6. The indicator device of claim 1, wherein the collapsible walker includes handlebars, and wherein movement of the collapsible walker from the locked walking position to the fully collapsed position causes the handlebars to pivot toward the user.

7. The indicator device of claim 1, wherein the collapsible walker includes front legs and rear legs, and wherein when in the locked walking position the front legs are closer to the rear legs than when the collapsible walker is in the fully collapsed position.

8. A collapsible walker comprising:

a main body frame assembly, a front leg affixed to the main body frame assembly, and a rear leg coupled to the main body frame assembly via a hinge, the walker being movable from a locked walking position over a range of unlocked positions into a fully collapsed position the walker including a lock mechanism for securement into the locked walking position;

a visual indicator affixed to the walker, wherein the visual indicator includes a first section and a second section;

a lock indicator cover affixed to the walker and having a window proximal said visual indicator, wherein when the walker is in the locked walking position the first section of the visual indicator is visible through the window, and when the walker is not in the locked walking position at least a portion of the second section of the visual indicator is visible through the window, the visibility of at least a portion of the second section signifying that the walker is not in the locked walking position.

9. The collapsible walker of claim 8, wherein the window is visible from a vantage point above the walker.

10. The collapsible walker of claim 8, wherein the visual indicator is one or more of color-coded and pattern-coded.

11. The collapsible walker of claim 8, wherein the first section of the visual indicator includes a first color and the second section of the visual indicator includes a second color.

12. The collapsible walker of claim 8, wherein the first section of the visual indicator includes a first pattern and the second section of visual indicator includes a second pattern.

13. The collapsible walker of claim 8, wherein the visual indicator is affixed to the hinge, and wherein the lock indicator cover is configured to cover at least a portion of the hinge.

14. The collapsible walker of claim 8, wherein the fully collapsed position is a non-walking position for the user.

15. The collapsible walker of claim 8, further comprising:

handlebars, wherein the handlebars are affixed to the main body assembly, and wherein movement of the collapsible walker from the locked walking position to the fully collapsed position causes the handlebars to pivot toward the rear leg.

16. The collapsible walker of claim 8, wherein when in the locked walking position, the front leg is closer to the rear leg than when the collapsible walker is in the fully collapsed position.

* * * * *